United States Patent [19]

Davies

[11] Patent Number: 4,989,878

[45] Date of Patent: Feb. 5, 1991

[54] WHEEL WORD GAME

[76] Inventor: Robert R. Davies, 3307 88th St., Lubbock, Tex. 79423

[21] Appl. No.: 451,783

[22] Filed: Dec. 18, 1989

[51] Int. Cl.[5] ..... A63F 3/00

[52] U.S. Cl. ..... 273/240; 273/272; 273/280

[58] Field of Search ..... 273/236, 240, 272, 280, 273/142 JA, 142 JD, 142 J

[56] References Cited

U.S. PATENT DOCUMENTS

| | | | |
|---|---|---|---|
| 1,504,758 | 8/1924 | Hays | 273/142 JA |
| 1,837,194 | 12/1931 | Baumgarten | 273/142 JA |
| 3,226,122 | 12/1965 | Rogers | 273/240 X |
| 3,254,893 | 6/1966 | Serviere | 273/240 |
| 4,799,678 | 1/1989 | Terzian et al. | 273/240 X |
| 4,884,816 | 12/1989 | Ford et al. | 273/240 |

OTHER PUBLICATIONS

"Wheel of Fortune", *Games,* Nov. 1986, p. #30.

*Primary Examiner*—Edward M. Coven
*Assistant Examiner*—William E. Stoll
*Attorney, Agent, or Firm*—Michael I. Kroll

[57] ABSTRACT

A wheel word game is provided and consists of a puzzle board on a first easel, for displaying the puzzle as it is worked out, an alphabet board for displaying letters called by the contestants, but not used in the puzzle, a plurality of puzzle cards, a plurality of free spin tokens for the contestants who win free spins, a dry erase pen, a wiping cloth, a plurality of contestant selection cards for selecting the contestants and their order of playing and a spinning wheel rotatably carried on a second easel to determine how each contestant plays the game.

8 Claims, 2 Drawing Sheets

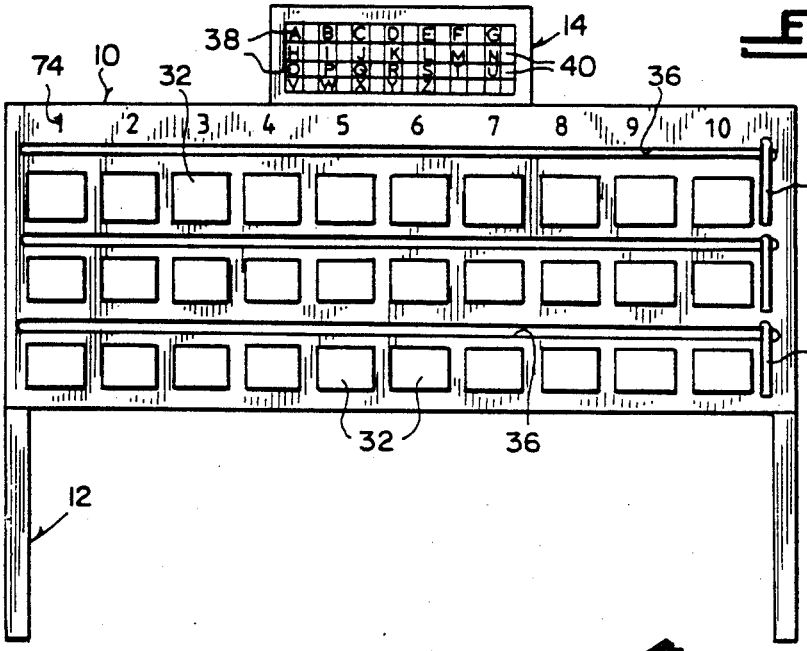
Fig. 1
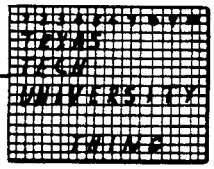
Fig. 5A
Fig. 5B
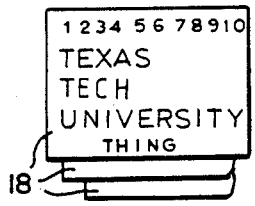
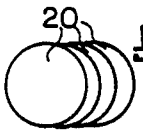
Fig. 6
Fig. 2
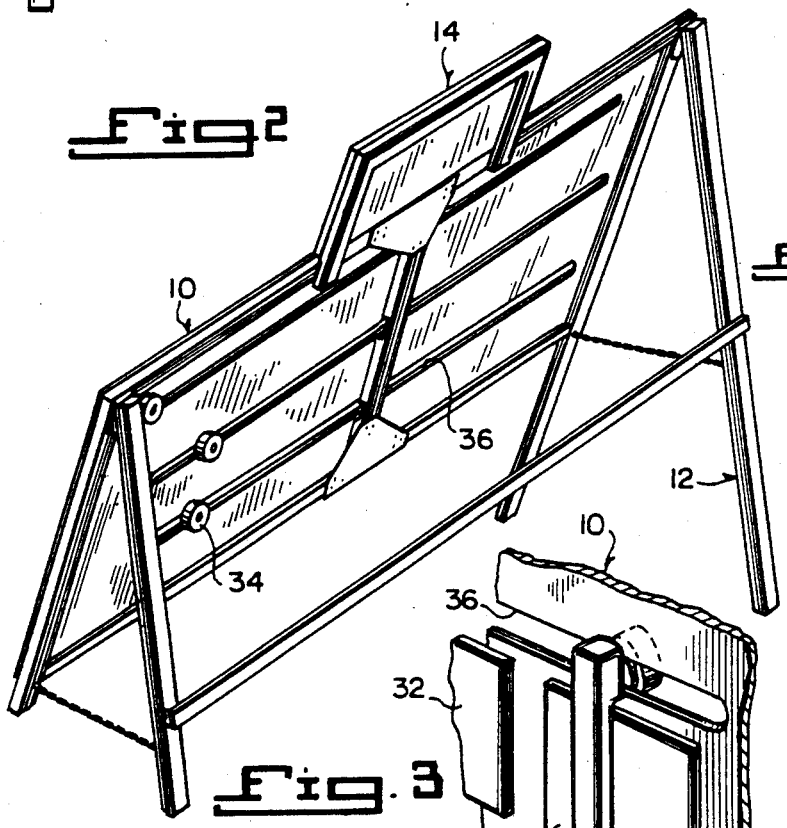
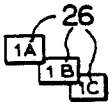
Fig. 9
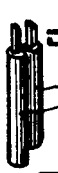
Fig. 7
Fig. 8
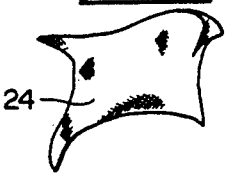
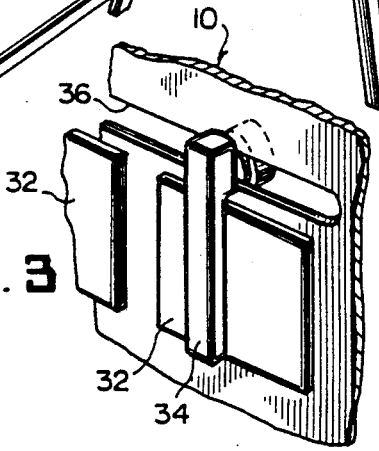
Fig. 3
Fig. 4
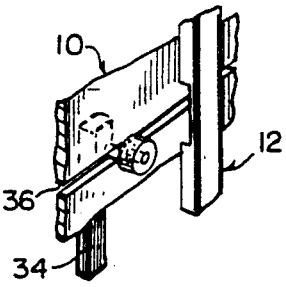

Fig.10
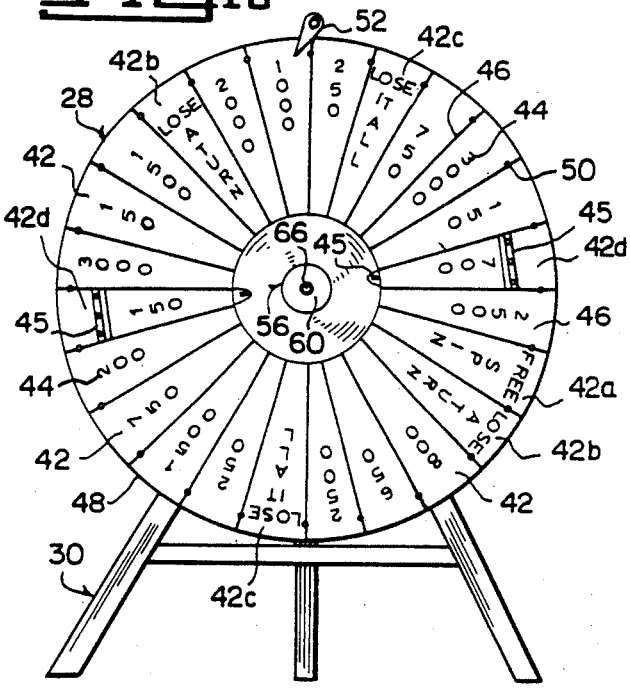
Fig.11
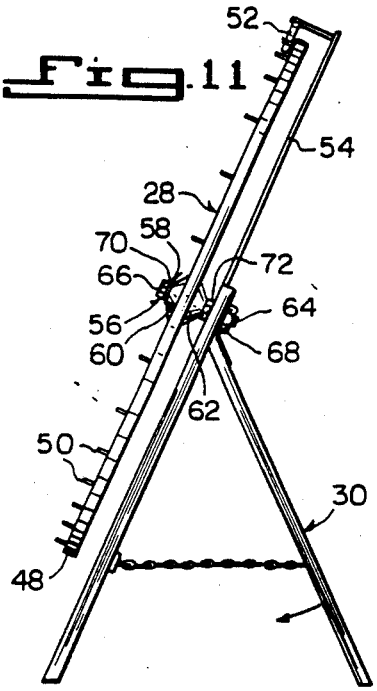
Fig.11A
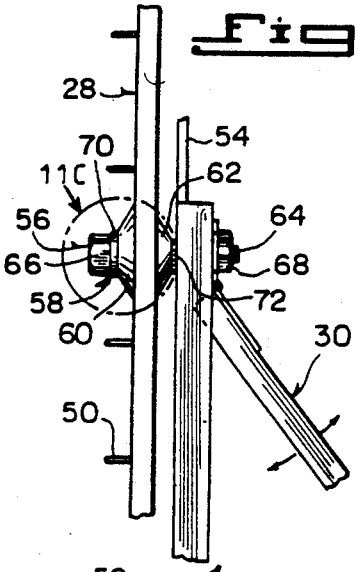
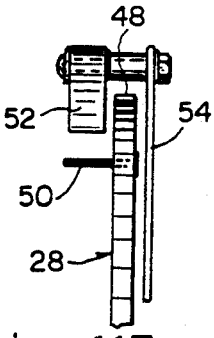
Fig.11B
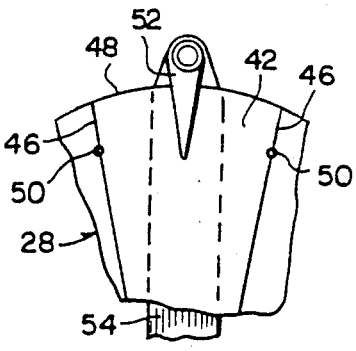
Fig.12
Fig.13
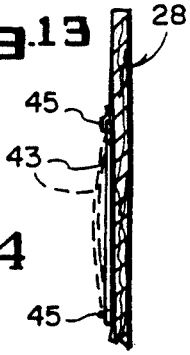
Fig.11C
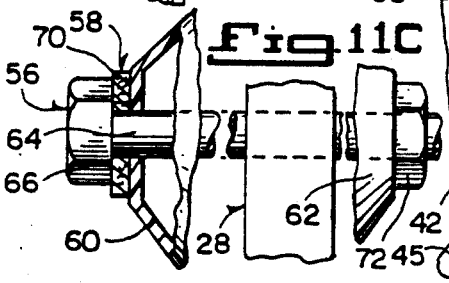
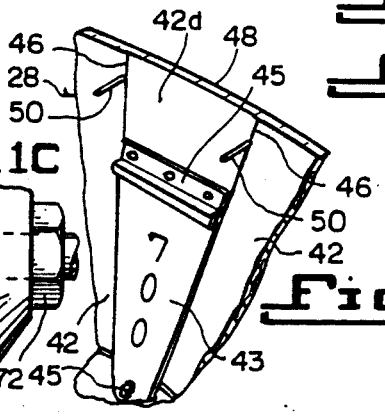
Fig.14

WHEEL WORD GAME

BACKGROUND OF THE INVENTION

1. Field of the Invention

The instant invention relates generally to games and more specifically it relates to a wheel word game.

2. Description of the Prior Art

Numerous games have been provided in the prior art that are adapted to utilize the formation of different types of words and sayings in playing the games. While these units may be suitable for the particular purpose to which they address, they would not be as suitable for the purposes of the present invention as heretofore described.

SUMMARY OF THE INVENTION

A primary object of the present invention is to provide a wheel word game that will overcome the shortcomings of the prior art devices.

Another object is to provide a wheel word game that allows any size group of people to enjoy the fun and excitement of a game that is similar to a very popular TV game show and is adaptable to various age groups.

An additional object is to provide a wheel word game that requires no outside power source to operate it, but instead uses a host and score keeper to manually control the play of the game.

A further object is to provide a wheel word game that is simple and easy to use.

A still further object is to provide a wheel word game that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

FIG. 1 is a front view of the puzzle board and the alphabet board on an easel used in playing the game.

FIG. 2 is a rear perspective view thereof.

FIG. 3 is a portion of a front perspective view of the puzzle board showing one of the slide markers in greater detail.

FIG. 4 is a portion of a rear perspective view of the puzzle board showing the retainer member of the slide marker in greater detail with respect to the vertical center brace of the easel.

FIG. 5A is a plan view of a hand made puzzle card.

FIG. 5B is a plan view of a plurality of printed puzzle cards.

FIG. 6 is a plan view of a plurality of free spin tokens.

FIG. 7 is a perspective view of two dry erase pens.

FIG. 8 is a plan view of a wiping cloth.

FIG. 9 is a plan view of a plurality of contestant selection cards.

FIG. 10 is a front view of the wheel on an easel used in playing the game.

FIG. 11 is a right side view thereof.

FIG. 11A is an enlarged portion of the right side view showing the structure in greater detail.

FIG. 11B is an enlarged portion of the right side view showing the pointer in greater detail.

FIG. 11C is an enlarged portion of the right side view as indicated by arrow 11C in FIG. 11A with parts broken away and in section showing the adjustment feature of the wheel to the easel.

FIG. 12 is a front view of a portion of the wheel showing the pointer in greater detail.

FIG. 13 is a cross sectional view taken through a portion of the wheel showing one of the flexible insert segments thereon.

FIG. 14 is a front perspective view of a portion of the wheel showing the flexible insert segment thereon.

DETAILED DESCRIPTION OF THE PREFERRED EMBODIMENTS turning new descriptively to the drawings, in which similar reference characters denote similar elements throughout the several views, all the figures illustrate a wheel word game which basically consists of a puzzle board 10 on a first easel 12 (FIGS. 1 through 4) for displaying the puzzle as it is worked out, an alphabet board 14 for displaying letters called by the contestants but not used in the puzzle (FIGS. 1 and 2), a hand made puzzle card 16 (FIG. 5A) or printed puzzle cards 18 (FIG. 5B), free spin tokens 20 for the contestants who win free spins (FIG. 6), dry erase pens 22 (FIG. 7), a wiping cloth 24 (FIG. 8), contestant selection cards 26 for selecting the contestants and their order of play (FIG. 9) and a spinning wheel 28 rotatably carried on a second easel 30 (FIGS. 10 through 14).

The puzzle board 10 is mounted on the first easel 12 which is a four legged type. The puzzle board 10 provides a plurality of squares 32 in rows, upon which a host writes the letters of the puzzle as they are called by the contestant. It also provides a way of showing the contestant and audience how many words and of what length are in the puzzle. Each row of letter squares 32 is made of a material compatible with the dry erase pens 22, so that at the end of the puzzle the puzzle board 10 can be wiped clean by the wiping cloth 24. There is a marker 34, which slides in a slot 36 running horizontally above each row of letter squares 32, to show how many letters are in each word. This marker 34 hangs down so it can be positioned at the right hand edge of the last letter square 32 to be used. It is brightly painted so as to be noticeable to both the contestant and the audience. If a stage size puzzle board 10 is used, where more than one word is used on a line, it will use a panel (not shown) riding in the slot 36 to indicate the space between the words.

The alphabet board 14 is a small board attached to the top of the puzzle board 10 and is of the same material as the letter squares 32. The alphabet board 14 is preprinted with all the letters 38 of the alphabet. Beside each letter 38 is a space 40 where a check mark can be made with one of the dry erase pens 22. When a letter is called but not used in the puzzle the host checks that letter 38 to show that it has been called but not used in the puzzle. In a stage size game the alphabet board 14 is free standing.

The spinning wheel 28 is a roulette type mounted on the second easel 30, which is a three legged type. The wheel 28 is marked off in segments 42 with dimensions giving the best eye appeal for the size of the wheel 28 used. Each segment 42 is brightly painted and numbers 44 in the hundreds to low thousands are printed inmost of the segments 42. There is one segment **42*a* having "free spin" printed thereon and strategically located, to afford the contestant a free spin. There are two segments 42***b*, each having "lose a turn" printed thereon and strategically located to indicate a contestant has lost his/her turn and two segments 42*c* strategically located to indicate a contestant has lost all of his/her accumulated score. Two segments 42*d*, opposite each other, each have structures 45 to overlay one of two flexible insert segments 43 in which one insert segment has a much higher numbered score printed thereon while the other insert segment has "lose it all" printed thereon. At each outer edge 46, just inside the outer periphery 48 of each segment 42 to 42*d*, a pin 50 projects perpendicular to the face of the spinning wheel 28, sufficiently to trip a pointer 52 pivotly positioned on an arm 54 that extends upwardly from the second easel 30 to the apex of the spinning wheel 28. After the spinning wheel 28 has been spun and comes to rest the pointer 52 will point to one of the segments 42 to 42*d* with the numbers or wording which determines the score of the contestant.

The wheel 28 is of such strength of weight as to prevent wobble and to provide sufficient inertia, while spinning to create a smooth, long lasting spin on an axle assembly 56 connected to the second easel 30. A drag structure 58 is built into the axle assembly 56, in which the drag structure 58 is adjustable to allow for spin duration and wear on the drag structure 58.

The axle assembly 56 includes a front bearing hub 60 and a rear bearing hub 62 positioned at the center of the wheel 28. An axle bolt 64 with a large head 66 extends through the front bearing hub 60, the wheel 28, the rear bearing hub 62 and the second easel 30. An axle nut 68 is threaded onto the end of axle bolt 64.

The drag structure 58 includes a drag washer 70 positioned on the axle bolt 64 between the large head 66 and the front bearing hub 60 and a drag adjustment nut 72 positioned on the axle bolt 64 between the rear bearing hub 62 and the second easel 30. Tension tightners are made between the drag adjustment nut 72 and the axle nut 68 while the drag on the wheel 28 is made by the drag washer 70 between the large head 60 and the front bearing hub 60.

All of the easels 12 and 30 are hinged to facilitate storage and handling, while the alphabet board 14 is detachable from the puzzle board 10 for the same reason. Above each vertical row of letter squares 32 on the puzzle board 10 are numbers 74 beginning with one through, however many squares 32 there are on the horizontal lines. These numbers 74 are to show the host where a letter should be printed on the puzzle board 10 without having to count.

The puzzle cards 16 or 18 are almost a duplication of the puzzle board 10. These cards show the puzzle, what kind of puzzle it is (i.e. event, person, place, etc.), the number of words, the number of letters in each word, and above each vertical row of letters are numbers as on the puzzle board.

HOW TO PLAY THE GAME

Contestant selection cards 26 are drawn to determine all of the contestants' turn at play. The number of groups of contestants and the number of contestants in each group must first be determined. If there are to be, say, five groups of three contestants the cards 26 for groups one through five should be used. If, for example, there is to be one group of three contestants and the rest audience the cards 26 for group one and as many audience cards should be used as there are people involved.

The first contestant, having determined by drawing a selection card 26, will spin the wheel 28. If the pointer 52 falls in a segment 42 with a number 44 printed in it the contestant will call for a consonant. If the letter called is contained in the puzzle the host will write that letter in the appropriate square/s 32. The contestant will be credited with the number of points shown in the segment 42 multiplied by the number of times that letter is contained in the puzzle. He/she will spin again. If the pointer 52 falls in the segment 42*a* marked "free spin" the contestant is given a free spin token 20 useable at any time during his/her turn at play. He/she will spin again. If the pointer 52 falls in a segment 42*b* marked "lose a turn" the contestant relinquishes his/her turn to the next player. If the pointer 52 falls in a segment 42*c* marked "lost it all" that player's accumulated score is erased and he/she relinquishes his/her turn.

Any letters called for but not used int he puzzle, with the exception of vowels called out of turn, will be checked off the alphabet board 14 by the host. A contestant who calls for a letter marked on the alphabet board 14 shall relinquish his/her turn. A vowel called out of turn is useable to subsequent contestants.

Vowels are; A, E, I, O, U. A vowel may be called for by a contestant before he/she spins and at no other time. When a vowel is called at the proper time, two hundred points are deducted from the contestant's accumulated score regardless of the number of times that vowel is or is not used in the puzzle. If a contestant spins and calls for a vowel instead of a consonant he/she has called vowel out of turn. A contestant calling for a vowel without a minimum of two hundred accumulated points is considered to have called a vowel out of turn. No points shall be deducted for calling a vowel out of turn. Contestants calling a vowel out of turn shall relinquish his/her turn.

The free spin tokens 20 may be returned to the host after a contestant has spun and landed on a segment 42*c* marked "lose it all", a segment 42*b* marked "lose a turn" or has called for a vowel out of turn.

The first contestant who can solve the puzzle is the winner for that puzzle and retains his/her accumulated score. The scores of the other contestants are zeroed out. The contestant with the highest accumulated score, after a predetermined number of games or a specified time, wins for that group. Play-offs between various group winners is popular when several groups are involved.

LIST OF REFERENCE NUMBERS

10 puzzle board
12 first easel
14 alphabet board
16 hand made puzzle card
18 printed puzzle card
20 free spin token
22 dry erase pen
24 wiping cloth
26 contestant selection card
28 spinning wheel
30 second easel
32 letter square on 10
34 marker
36 slot in 10
38 one letter of the alphabet on 14
40 space on 14
42 segment on 28
42*a* "free spin" segment on 28

42b "lose a turn" segment on 28
42c "lost it all" segment on 28
42d overlay segment on 28
43 flexible insert segment
44 numbers on 42
45 overlay structure
46 outer edge
48 outer periphery
50 pin
52 pointer
54 arm on 30
56 axle assembly
58 drag structure in 56
60 front bearing hub
62 rear bearing hub
64 axle bolt
66 large head on 64
68 axle nut
70 drag washer
72 drag adjustment nut
74 number on 10

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A wheel word game comprising:

(a) a puzzle board on a first easel, for displaying a puzzle as it is worked out, said puzzle board including a plurality of squares in which a host can write thereon the letters of the puzzle as they are called by the contestant to indicate to the contestant and audience how many words and of what length are in the puzzle, said puzzle board having a horizontal slot above each of the rows of said letters squares, and a marker in each of said slots, in which said marker can slide in said slot above each row of said letter squares to show how many letters are in each word, said marker hangs down so it can be positioned at the right hand edge of said last letter square to be used;

(b) an alphabet board for displaying letters called by a contestant, but not used in the puzzle;

(c) a plurality of puzzle cards having the completed puzzle written thereon;

(d) a plurality of free spin tokens for a contestant who wins free spins;

(e) a dry erase pen;

(f) a wiping cloth;

(g) a plurality of contestant selection cards for selecting a contestant and their order of play; and (h) a spinning wheel rotatably carried on a second easel to randomly determine the options of each contestant for each play of the game.

2. A wheel word game as recited in claim 1, wherein each of said letter squares is fabricated out of a material compatible with said dry erase pen so that at the end of the puzzle the puzzle board can be wiped clean by said wiping cloth.

3. A wheel word game as recited in claim 2, wherein said alphabet board is a small board attached to the top of said puzzle board and is fabricated out of the same material as said letter squares, in which said alphabet board is preprinted with all the letters of the alphabet and beside each letter is a space where a check mark can be made with said dry erase pen when a letter is called but not used in the puzzle.

4. A wheel word game as recited in claim 3, wherein said spinning wheel is a roulette type that includes:

(a) a plurality of segments having numbered scores printed thereon;

(b) one segment having "free spin" printed thereon;

(c) two segments each having "lose a turn" printed thereon;

(d) two segments each having "lose it all" printed thereon;

(e) a plurality of pins, each projecting perpendicular to the face of said spinning wheel at an outer edge just inside the outer periphery of each said segment;

(f) a pointer positioned at the apex of said spinning wheel so that said pins can sufficiently trip said pointer until said spinning wheel that has been spun comes to rest in which said pointer will point to one said segment which will determine the score of the contestant.

5. A wheel word game as recited in claim 4, wherein said spinning wheel further includes:

(a) an axle assembly connected to the second easel so that said wheel is of such strength of weight as to prevent wobble and to provide sufficient inertia, while spinning to create a smooth, long lasting spin on said axle assembly; and (b) a drag structure built into said axle assembly, on which said drag structure is adjustable to allow for spin duration and wear on said drag structure.

6. A wheel word game as recited in claim 5, wherein said axle assembly includes:

(a) a front bearing hub positioned at the center of said wheel;

(b) a rear bearing hub positioned at the center of said wheel;

(c) an axle bolt having a large head, said bolt extends through said front bearing hub, said wheel, said rear bearing hub and the second easel; and (d) an axle nut threaded onto the end of said axle bolt.

7. A wheel word game as recited in claim 6, wherein said drag structure includes:

(a) a drag washer positioned on said axle bolt between the large head and said front bearing hub; and (b) a drag adjustment nut positioned on said axle bolt between said rear bearing hub and the second easel, so that tension tightness is made between said drag adjustment nut and said axle nut, while the drag on said wheel is made by said drag washer between the large head and said front bearing hub.

8. A wheel word game as recited in claim 7, further including:

(a) a first flexible insert segment having a higher numbered score printed thereon;
(b) a second flexible insert segment having "lost it all" printed thereon; and
(c) said two segments opposite from each other, each having an overlay structure to accommodate one of said two flexible insert segments thereon so as to balance said spinning wheel.

* * * * *